US008747516B2

(12) United States Patent
Ono et al.

(10) Patent No.: US 8,747,516 B2
(45) **Date of Patent: *Jun. 10, 2014**

(54) IRON-BASED POWDER FOR POWDER METALLURGY

(75) Inventors: Tomoshige Ono, Chiba (JP); Shigeru Unami, Chiba (JP); Takashi Kawano, Chiba (JP); Yukiko Ozaki, Chiba (JP)

(73) Assignee: JFE Steel Corporation, Tokyo (JP)

( * ) Notice: Subject to any disclaimer, the term of this patent is extended or adjusted under 35 U.S.C. 154(b) by 446 days.

This patent is subject to a terminal disclaimer.

(21) Appl. No.: 12/734,775

(22) PCT Filed: Dec. 13, 2007

(86) PCT No.: PCT/JP2007/074473

§ 371 (c)(1),
(2), (4) Date: Jun. 2, 2010

(87) PCT Pub. No.: WO2009/075042

PCT Pub. Date: Jun. 18, 2009

(65) Prior Publication Data

US 2010/0255332 A1 Oct. 7, 2010

(51) Int. Cl.
*B22F 1/02* (2006.01)

(52) U.S. Cl.
USPC ..... 75/252; 419/35; 419/36

(58) Field of Classification Search
USPC ..... 75/252, 246
See application file for complete search history.

(56) References Cited

U.S. PATENT DOCUMENTS

| | | | | |
|---|---|---|---|---|
| 3,357,818 | A * | 12/1967 | Findeisen | 75/252 |
| 6,174,494 | B1 * | 1/2001 | Lowden et al. | 419/66 |
| 6,464,751 | B2 | 10/2002 | Uenosono et al. | |
| 7,192,464 | B2 * | 3/2007 | Hammond | 75/252 |
| 7,255,724 | B2 * | 8/2007 | Larsson et al. | 75/252 |
| 7,384,446 | B2 * | 6/2008 | Unami et al. | 75/252 |
| 7,390,345 | B2 * | 6/2008 | Solimnjad | 75/252 |
| 7,645,317 | B2 * | 1/2010 | Fujiura et al. | 75/252 |
| 7,867,314 | B2 * | 1/2011 | Ono et al. | 75/252 |
| 2001/0035069 | A1 | 11/2001 | Arvidsson et al. | |
| 2003/0219617 | A1 | 11/2003 | Ozaki et al. | |
| 2004/0038067 | A1 | 2/2004 | Ozaki et al. | |

FOREIGN PATENT DOCUMENTS

| | | |
|---|---|---|
| CN | 1373696 A | 10/2002 |
| JP | A-01-219101 | 9/1989 |
| JP | A-02-217403 | 8/1990 |
| JP | A-03-162502 | 7/1991 |
| JP | A-05-148505 | 6/1993 |
| JP | A-06-256801 | 9/1994 |
| JP | A-2002-515542 | 5/2002 |
| JP | A-2003-508635 | 3/2003 |
| JP | A-2003-105405 | 4/2003 |
| JP | A-2004-143554 | 5/2004 |
| JP | A-2004-232079 | 8/2004 |
| JP | A-2005-232592 | 9/2005 |
| JP | A-2005-264192 | 9/2005 |
| JP | A-2007-332423 | 12/2007 |
| WO | WO 01/17716 A1 | 3/2001 |

OTHER PUBLICATIONS

Office Action issued in Chinese Patent Application No. 200780101896.0 dated Aug. 25, 2011 (with translation).
Japanese Office Action issued in Application No. 2006-166189; Dated Mar. 1, 2011 (With Translation).
Japanese Office Action issued in Application No. 2006-314924; Dated Mar. 16, 2011 (With Translation).
International Search report issued in Application No. PCT/JP2007/074473; mailed on Jan. 29, 2008 (With Translation).
International Preliminary Report on Patentability issued in Application No. PCT/JP2007/074473; Dated Aug. 10, 2010 (With Translation).

* cited by examiner

*Primary Examiner* — George Wyszomierski
*Assistant Examiner* — Ngoclan T Mai
(74) *Attorney, Agent, or Firm* — Oliff PLC

(57) ABSTRACT

Flowability-improving particles are adhered to surfaces of iron powder through a binder to provide an iron-based powder for powder metallurgy which has excellent flowability and which is capable of uniformly filling a thin-walled cavity and compaction with high performance of ejection force.

8 Claims, 2 Drawing Sheets

○ (Good)

△ (Poor)

× (None)

IRON-BASED POWDER FOR POWDER METALLURGY

TECHNICAL FIELD

The present invention relates to an iron-based powder suitable for use in powder metallurgy and a method for producing the same.

BACKGROUND ART

Powder metallurgical technology is technology for producing products (sintered compacts) by compaction-molding metal-based powders used as low materials with a mold and sintering the resultant green compacts.

Powder metallurgical technology is capable of producing machine parts having complicated shapes with high dimensional precision and is thus capable of significantly decreasing the production costs of the machine parts. Therefore, various machine parts produced by applying the powder metallurgical technology are used in many fields. Further, in recent years, the requirement for miniaturization or weight lightening of machine parts has increased, and various raw material powders for powder metallurgy for producing small and lightweight machine parts having sufficient strength have been investigated. For example, Japanese Unexamined Patent Application Publication No. 1-219101 (Patent Document 1), Japanese Unexamined. Patent Application Publication No. 2-217403 (Patent Document 2), and Japanese Unexamined Patent Application Publication No. 3-162502 (Patent Document 3) disclose raw material powders for powder metallurgy produced by adhering an alloying powder to surfaces of a pure iron powder or alloy steel powder with a binder (referred to as "segregation-free treatment"). Such powders mainly composed of iron (referred to as an "iron-based powder" hereinafter) are usually produced by adding an additive powder (e.g., a copper powder, a graphite powder, an iron phosphide powder, a manganese sulfide powder, or the like) and a lubricant (e.g., zinc stearate, aluminum stearate, or the like) and the resultant mixed powders are supplied to production of machine parts.

As the pure iron powder or alloy steel powder used as a raw material of the iron-based powder, there are an atomized iron powder, a reduced iron powder, and the like according to the production methods. Here, a pure iron powder may be referred to as an iron powder, but the term "iron powder" in the classification by production methods is used in a broad sense including an alloy steel powder. Hereinafter, the term "iron powder" represents an iron powder in the broad sense. The alloy steel powder includes steel powders other than prealloys, i.e., a partially alloyed steel powder and a hybrid alloyed steel powder, However, the iron-based powder, the additive powder, and the lubricant have different characteristics (i.e., the shape, particle size, and the like), and thus flowability of a mixed powder is not uniform. Therefore, the following problems (a) to (c) occur:

(a) The iron-based powder, the additive powder, the lubricant, and the like locally unevenly distribute due to the influence of vibration or dropping during transport of the mixed powder to a storage hopper. The deviation due to differences in flowability cannot be completely prevented even by the segregation-free treatment.

(b) Since relatively large spaces are produced between particles of the mixed powder charged in the hopper, the apparent density of the mixed powder decreases.

(c) The apparent density of the mixed powder depositing in a lower portion of the hopper increases over time (i.e., due to the influence of gravitation), while the mixed powder in an upper portion of the hopper is stored at a low apparent density. Therefore, the apparent density of the mixed powder is non-uniform in the upper and lower portions of the hopper.

It is difficult to mass-produce machine parts having uniform strength using such a mixed powder.

In order to solve the above problems (a) to (c), it is necessary to increase flowability of the mixed powder of the iron-based powder, the additive powder, and the lubricant.

Therefore, an iron-based powder mainly composed of an iron powder having a predetermined range of particle diameters is proposed.

On the other hand, U.S. Pat. No. 3,357,818 (Patent Document 5) discloses, as means for improving flowability of a metallurgical powder, a technique of adding finest grained inorganic compounds, particularly oxide compounds (preferably having a particle diameter of 1 or less), in an amount of about 25% of an organic lubricant. Examples of the inorganic compounds include silic acid, titanium dioxide, zirconium dioxide, silicon carbide, iron oxide ($Fe_2O_3$), and the like.

In addition, Japanese Unexamined Patent Application Publication (Translation of PCT Application) No. 2002-515542 (Patent Document 6) discloses a technique for improving flowability of an iron powder for powder metallurgy by adding 0.005 to 2% by mass of a metal oxide, such as $SiO_2$ of less than 500 nm or the like. Also, this publication introduces, as segregation-free treatment, a wet method using a resin such as cellulose or the like as a binder (a method of adhering a binder in a natural liquid state or a solvent solution state to an iron powder and then removing liquid contents such as a solvent and the like) and describes that a method of dry-mixing the metal oxide after the removal of a liquid content is preferred.

DISCLOSURE OF INVENTION

Problem to be Solved by the Invention

However, as a result of examination, the inventors newly found the following: That is, some of various fine particles (for example, $SiO_2$) described in U.S. Pat. No. 3,357,818 (Patent Document 5) and Japanese Unexamined Patent Application Publication (Translation of PCT Application) No. 2002-515542 (Patent Document 6) frequently decrease mechanical properties of sintered compacts, and it is undesirable to add such fine particles in a blind way.

The present invention aims at solving the above-mentioned problems. Namely, an object of the invention is to provide an iron-based powder for powder metallurgy which is excellent in flowability and capable of uniformly filling a thin-walled cavity and which does not decrease mechanical properties of sintered compacts.

In addition, as a result of examination, the inventors newly found the following: It is practically difficult to sufficiently mix finest particles added for improving flowability so that the finest particles function on the most part of an iron powder. Therefore, a conventional method does not fully utilize the ability of a flowability-improving agent.

Accordingly, in a further preferred embodiment of the present invention, an object is to resolve the problems and provide a method for producing an iron-based powder which satisfactorily exhibits the effect of a flowability-improving agent and also provide an iron-based powder.

Means for Solving the Problem

The present invention is as follows.

(1) An iron-based powder for powder metallurgy characterized in including iron powder with surfaces to each of which flowability-improving particles adhere through a binder.

The iron powder is an iron powder in the broad sense including an alloy steel powder. The binder may adhere at least a portion of an additive powder (particularly, an alloying powder) to the iron powder.

(2) The iron-based powder for powder metallurgy of the invention described above in (1), wherein the iron powder contains less than 50% by mass of an iron powder not having the binder.

For example, when a first iron powder is subjected to segregation-free treatment and then mixed with a second iron powder not subjected to segregation-free treatment, the second iron powder corresponds to an "iron powder not having the binder".

(3) The iron-based powder for powder metallurgy of the invention described above in (1) or (2), wherein the surfaces of the iron powder are previously treated with a wettability-improving agent to improve wettability with the binder.

Specifically, the sentence "the surfaces of the iron powder are treated with a wettability-improving agent to improve wettability with the binder" represents that the iron powder surfaces are coated with the wettability-improving agent to such an extent that a wettability-improving effect is exhibited.

(4) The iron-based powder for powder metallurgy of the invention described above in any one of (1) to (3), wherein the melting point of the flowability-improving particles is 1800° C. or more, and the flowability-improving particles are not sintered with each other during sintering of an iron-based powder compact.

The flowability-improving particles preferably include at least one selected from $TiO_2$, $Al_2O_3$, $ZrO_2$, $Cr_2O_3$, and ZnO, and the average particle diameter of the flowability-improving particles is preferably in a range of 5 to 500 nm.

(5) The iron-based powder for powder metallurgy of the invention described above in any one of (1) to (4), wherein the flowability-improving particles include PMMA and/or PE, and the average particle diameter of the flowability-improving particles is in a range of 5 to 500 nm.

Both the flowability-improving particles described above in (4) and the flowability-improving particles described above in (5) may be added together.

(6) The iron-based powder for powder metallurgy of the invention described above in any one of (1) to (5), wherein the binder is at least one selected from zinc stearate, lithium stearate, calcium stearate, stearic acid monoamide, and ethylenebis(stearamide).

(7) The iron-based powder for powder metallurgy of the invention described above in any one of (1) to (6), wherein the iron powder is an atomized iron powder and/or a reduced iron powder.

(8) The iron-based powder for powder metallurgy of the invention described above in any one of (1) to (7), wherein the flowability-improving particles are contained at a ratio of 0.01 to 0.3 parts by mass relative to 100 parts by mass of the iron powder.

(9) A method for producing an iron-based powder containing at least an iron powder and flowability-improving particles, the method including a step of adhering at least a binder to at least a portion of the iron powder (referred to as "raw material powder A"), a step of mixing the flowability-improving particles with part of a material powder of the iron-based powder without adding a binder (referred to as "raw material powder B"), and a step of adding and mixing the raw material powder B (mixture of part of a material powder of the iron-based powder and the flowability-improving particles) with the raw material powder A (iron powder having the binder adhered thereto).

(10) A method for producing an iron-based powder characterized in including a step of adhering at least a binder to a first iron powder, a step of mixing flowability-improving particles with a second iron powder to which a binder is not adhered, and a step of subsequently mixing the first iron powder with the second iron powder (containing the flowability-improving particles).

The invention described above in (10) is the most preferred embodiment of the invention described above in (9). A typical example of "a step of adhering at least a binder" to at least a portion of the iron powder or a first iron powder is segregation-free treatment. Therefore, at least part of an additive powder (particularly, an alloying powder) may be adhered to the iron powder by the treatment.

Figure 1:
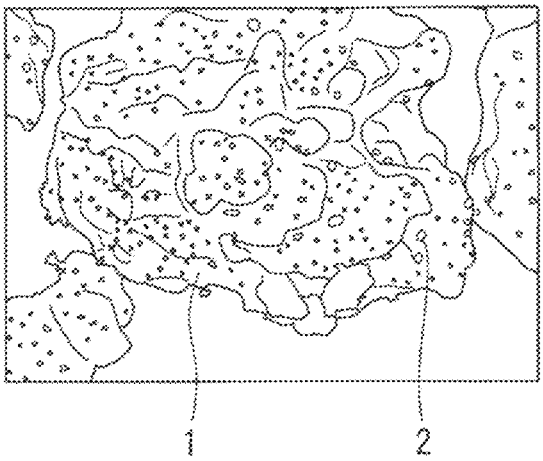
FIG. 1 is an explanatory view showing an example of appearance of an iron-based powder of the present invention.

| [Reference Numerals] | |
|---|---|
| 1 | atomized iron powder |
| 2 | flowability-improving particle |
| 11 | cavity |
| 12 | iron-based powder |
| 13 | filling shoe |
| 14 | vessel |
| 15 | moving direction |

BEST MODE FOR CARRYING OUT THE INVENTION

A preferred embodiment of the present invention is described below. Except for a portion concerning mixing of flowability-improving particles, known powders for powder metallurgy (including selection of raw materials and additives) and production methods therefor (including procedures and apparatuses) (disclosed in, for example, Japanese Unexamined Patent Application Publication No. 2005-232592, etc) can be applied.

(Method of Producing Iron-Based Powder)

First, an iron powder and an alloy component are mixed together with a binder under heating using a mixer to produce an iron-based powder for powder metallurgy (a type of segregation-free treatment). Flowability-improving particles are added after the segregation-free treatment and are mixed in a dry state with a mixer.

Here, other additives such as a cutting ability improving agent and the like may be added together with an alloy component and may be mixed under heating together with a binder. The additives are generally powders of about 1 to 20 μm. The alloy component is typically a graphite powder, a Cu powder, a Ni powder, a Cr powder, a W powder, a Mo powder, a Co powder, or the like. The cutting ability improving agent is typically a MnS powder, a $CaF_2$ powder, a phosphate powder, a BN powder, or the like. In addition, a lubricant having a higher melting point than the heating temperature may be added at the same time as the alloy component.

Further, after the segregation-free treatment, a powder lubricant is preferably added for further securing compactability (referred to as a "free lubricant"). Each lubricant can be appropriately selected from known lubricants. The flowability-improving particles are preferably added and mixed with the iron powder (iron-based powder) after the segregation-free treatment at the same time as the free lubricant.

As the mixer, a high-speed mixer which is a mechanical mixing-type mixer is preferred from the viewpoint of mixing force. However, the mixer may be appropriately selected according to the production amount of the iron-based powder, desired flowability, and the like.

Specific procedures include charging a predetermined amount of iron powder in a high-speed mixer, and adding the alloy component such as a graphite powder, a Cu powder, or the like and the binder. After these raw materials are charged, heating and mixing is started. The rotational speed of a rotating impeller in the high-speed mixer depends on the size of a mixing tank, and the shape of the rotating impeller, but is generally preferably about 1 to 10 m/sec in terms of the peripheral speed at the tip of the rotating impeller. Heating and mixing is performed until the temperature in the mixing tank is the melting point of the binder or higher, and mixing is performed at a temperature of the melting point or higher for about 1 to 30 minutes. After the raw materials are sufficiently mixed, the mixing tank is cooled. When the binder is solidified in the cooling step, additives such as the alloy component and the like are adhered to the surfaces of the iron powder.

The binder may be appropriately selected from known binders, and any one of a heat melting type and a type of being melted by heating and then solidified by cooling can be used. In particular, a binder having lubricity after solidification is preferred.

The reason for this is that this type decreases frictional force between powder particles, improves flowability of a powder, and promotes rearrangement of particles at an early stage of compaction. Specifically, metallic soap, amide wax, polyamide, polyethylene, polyethylene oxide, or the like is used. In particular, zinc stearate, lithium stearate, calcium stearate, stearic acid monoamide, and ethylenebis(stearamide) are preferred. These binders may be used alone or in a mixture of two or more. The preferred adding amount is about 0.05 to 0.8 parts by mass relative to 100 parts by mass of iron powder.

Meanwhile, as the iron powder, there are various iron powders according to the production methods, but a water atomized iron powder or a reduced iron powder is preferably used in view of compactability, characteristics of a compacted body, and characteristics of a sintered body. Such an iron powder has irregularity in particle surfaces, and the strength of a compacted body and sintered body is increased due to engagement of irregularity during powder compaction. The iron powder is not particularly limited as long as it is in the above-defined categories, i.e., a pure iron powder or an alloy steel powder (including a partially alloyed steel powder and a hybrid alloyed steel powder). The pure iron powder contains 98% or more of iron and impurities as the balance. The alloy steel powder contains alloy components such as Mn, Cu, Mo, Cr, W, Ni, P, S, V, Si, and the like in a total of about 10% or less. In addition, previous addition of an alloy composition to molten steel is referred to as "prealloying", bonding of particles containing alloy components to iron powder surfaces by diffusion reaction is referred to as "partial alloying", and combination of prealloying and partial alloying is referred to as "hybrid alloying".

The particle diameter of an iron powder is generally in a range of 60 to 100 μm in terms of average particle diameter (according to sieve analysis defined by Japan Powder Metallurgy Association standard JPMA P02-1992). (Wettability-improving treatment with wettability-improving agent)

The binder is molten at a melting point or higher so that particle surfaces of a raw material powder in a mixing tank are wetted with the binder. Since the water atomized iron powder and the reduced iron powder have irregularity on the surfaces thereof, the binder tends to locally stay in the irregularity. Therefore, the binder nonuniformly distributes on the surfaces of the iron powder. In order to make the binder distribution uniform, it is necessary to improve wettability of iron powder surfaces with the binder. Therefore, it is preferred to use a wettability-improving agent for improving wettability of iron powder surfaces with the binder.

An effective method of treatment with the wettability-improving agent is a method of previously coating at least iron powder surfaces with the wettability-improving agent before the segregation-free treatment (before heat-mixing of the binder, the iron powder, and other alloy components). When a silane coupling agent is used, the silane coupling agent (liquid) may be added to the iron powder charged in a mixing tank, followed by stirring at room temperature for about 1 to 10 minutes. Then, the binder and the other alloy components are charged and heat-mixed. The preferred coating amount is about 0.005 to 0.1 parts by mass relative to 100 parts by mass of iron powder.

Other conceivable wettability-improving agents include an acethylene glycol surfactant and a polyhydric alcohol surfactant. Both agents are liquid, and the treatment method and proper coating amount are the same as the silane coupling agent. However, the stirring conditions may be controlled according to the wettability-improving agent used. As a mixing device, a device with high mixing force (mixing speed) is preferably used, and for example, a rotor mixer such as a Henschel mixer, a high-speed mixer, or the like, or a mixer having mixing force equivalent to that of such a mixer is preferred.

(Flowability-Improving Particles)

The flowability-improving particles used in the present invention are composed of fine powder having the effect of improving flowability of the atomized iron powder. In the present invention, in consideration of the viewpoint that the mechanical properties of sintered compacts are not decreased, types of the flowability-improving particles are roughly divided into the following two:

(A) particles having a melting point of 1800° C. or more (preferably inorganic compounds, particularly inorganic oxides, specifically at least one of $TiO_2$, $Al_2O_3$, $ZrO_2$, $Cr_2O_3$, and ZnO, and most preferably $TiO_2$); and (B) at least one of polymethyl methacrylate (PMMA) and polyethylene (PE).

It is generally known that if fine irregularity is present on surfaces of powder particles, the contact area between the particles is decreased, thereby decreasing adhesive force between the particles. Although the water atomized iron powder and reduced iron powder also have irregularity in the surfaces, the irregularity is not sufficient for decreasing adhesive force because the curvature is 0.1 to 50 $\mu m^{-1}$ and relatively small. By adhering the flowability-improving particles to the iron powder surfaces, the adhesive force between the particles can be sufficiently decreased.

However, some fine particles decrease the mechanical properties of sintered compacts, such as strength and toughness ($SiO_2$ and the like), and not all types of fine particles can be used. As a result of research, the inventors found that particles belonging to the above-described group (A) or (B) do not decrease the mechanical properties of sintered compacts. The inventors estimate the reason why these particles do not decrease mechanical properties as follows.

Since particles having a melting point of less than 1800° C. are melted or softened by sintering (about 900° C. to 1400° C.), the particles are supposed to be deformed at an acute angle in conformity with the gaps between the particles, thereby enhancing the adverse effect on the mechanical properties. On the other hand, as in the group (A), when the melting point is 1800° C. or more, the particles are thought to maintain a state close to the initial (relatively) spherical shape, thereby causing no adverse effect on the mechanical properties. The group (B) consists of organic substances which are thought to disappear due to decomposition during sintering, thereby causing little adverse effect on the mechanical properties.

In addition, in the group (A), inorganic substances, particularly oxides, are preferred because substances having high melting points are easily available. Also, it is determined from the results of experiments and examination that in the group (A), at least one of $TiO_2$, $Al_2O_3$, $ZrO_2$, $Cr_2O_3$, and ZnO, particularly $TiO_2$, is preferred. Further, it is determined from the results of examination of particle diameters, hardness, and the like that in the group (B), particularly PMMA and PE among organic substances are preferred.

The flowability-improving particles are adhered to the iron powder through the binder. In order to adhere finest grained particles to other particles by sufficiently dispersing the particles, generally, procedures of dispersing the finest grained particles in a liquid to coat the particles with the liquid and then evaporating the liquid are required. However, as a result of research in the present invention, it was found that flowability can be sufficiently decreased by adding the binder to the iron powder and then dry-mixing the finest grained particles to adhere the finest grained particles to the iron powder through the binder. This is possibly due to the following facts.

The flowability-improving particles easily adhere to the surface of the binder.

Exposed portions of the binder most degrade flowability with other particles, and in order to improve flowability, it is highly effective to impart projections to the surfaces of the binder using particles.

In the method of the present invention, the above-exemplified binder which is heat-melted for coating is more preferred than other binders (for example, a binder which is dissolved in a solvent for coating). This is because the heat-melting type binder exhibits a strong force of adsorbing flowable particles.

The average particles diameter of the flowability-improving particles is preferably 5 nm or more. When the average particle diameter of the flowability-improving particles is less than 5 nm, the particles may be buried in irregularity of the surfaces of the iron powder or in the lubricant present on the surfaces of the iron powder. These fine particles are present as aggregates, but when the particles are excessively fine, the particles undesirably adhere while staying in aggregates to the surfaces of the iron powder. In addition, the production cost of fine particles generally increases as the particle diameter decreases.

The average particles diameter of the flowability-improving particles is preferably 500 nm or less. When the average particle diameter exceeds 500 nm, the diameter is the same as the curvature of irregularity originally present in the surfaces of the iron powder, and thus the meaning of intended adhesion of the particles is significantly decreased. In particular, the flowability-improving particles of above (A) are present in a sintered body without decomposition during sintering. The particles can be regarded as an inclusion in steel, and when the particles are excessively large, strength of a sintered body is decreased. The average particle diameter is more preferably 100 nm or less.

For these reasons, the average particle diameter of the flowability-improving particles is preferably in the range of 5 to 500 nm. As the particle diameter of the flowability-improving particles, a value determined by BET specific surface measurement on the assumption that the shape of the particles is spherical is used for (A), and a value measured by a microtrack method using ethanol as a dispersion medium is used for (B).

In order to obtain the significant effect of improving flowability, the amount of the flowability-improving particles added is preferably 0.01 parts by mass or more relative to 100 parts by mass of the iron powder. The amount is more preferably 0.05 parts by mass or more. On the other hand, the amount of the flowability-improving particles added is preferably 0.3 parts by mass or less relative to 100 parts by mass of the iron powder. When the amount exceeds 0.3 parts by mass, in compaction under the same pressure, the density of a green compact decreases, and consequently, strength of a sintered body undesirably decreases. The amount is more preferably 0.2 parts by mass or less.

Therefore, the amount of the flowability-improving particles added is preferably in a range of 0.01 to 0.3 parts by mass relative to 100 parts by mass of the iron powder.

The effect of addition of the flowability-improving particles is that fine irregularity is provided in the surfaces of the iron powder to decrease the contact area between particles, thereby decreasing adhesive force. There is also the effect of inhibiting adhesion between the binder and the binder present on the surfaces of the iron powder. FIG. 1 is a schematic view showing an example of the iron-based powder of the present invention. FIG. 1 indicates that the flowability-improving particles disperse and adhere to the surfaces of atomized iron powder 1. In addition, it was confirmed by a C distribution and an oxide metal element distribution obtained by EPMA that the binder is present in a portion where the flowability-improving particles adhere.

(Addition of Iron Powder not Having Binder)

In another mode of the present invention, the iron-based powder contains an iron powder not having the binder. Considering the above-mentioned function principle of the flowability-improving particles, the iron powder not having the binder adhering thereto is considered to have excellent flowability. This mode is based on the above-described viewpoint, and the iron powder contains less than 50% by mass of an iron powder not having the binder. Such an iron-based powder can be prepared by mixing an iron powder not subjected to segregation-free treatment with an iron powder subjected to segregation-free treatment. The average particle diameter range of the iron powder preferred for addition is the same as the above-described general iron powder.

The amount of the iron powder (having uncoated surfaces) not having the binder on the surfaces is less than 50% by mass relative to the whole of the iron powder. When amount of the iron powder not having the binder is 50% by mass or more, ejection force increases during compaction, and in some cases, die galling phenomenon may occur, and/or defects may occur in a compacted body. The amount of the iron powder not having the binder is more preferably 20% by mass or less. The amount is preferably 5% by mass or more from the viewpoint of achieving a significant effect, and more preferably 10% by mass or more.

Further, as an unexpected effect, the flowability-improving particles are first mixed with the iron powder not having the binder and then mixed with the iron powder having the binder (i.e., after the segregation-free treatment), thereby further improving flowability. Although the reason for this is not elucidated, a supposed reason is that the flowability-improving particles more uniformly disperse on the entire surface of the binder due to the aggregation preventing effect that aggregates of the flowability-improving particles are ground by the iron powder with uncoated surfaces.

This mechanism is expected when the particles not having the binder are replaced by another material powder not having the binder (for example, an alloying powder such as a Cu powder or the like, a cutting ability improving powder, or the like). Namely, a similar effect is obtained by mixing the flowability-improving particles with part of a raw material powder of the iron-based powder, which is not limited to an iron powder, without adding the binder (for example, referred to as "raw material powder B") and then adding and mixing the raw material powder B with an iron powder subjected to segregation-free treatment (referred to as "raw material powder A"). Of course, the raw material powder used for the raw material powder B is not limited to one type and may contain whole amount of a certain additive powder.

As the particles not having the binder in the raw material powder B, an iron powder is most preferably used. This is because of the advantage that the mass of particles and the amount of particles added can be increased to enhance grinding force, and unlike other raw material powders, there is no possibility of segregation even if the binder is not used.

(Other)

The content of a composition (contained as an alloy steel powder and adhering with the binder) other than iron in the iron-based powder of the present invention is 10 parts by mass or less relative to 100 parts by mass of iron powder. When the iron-based powder of the present invention is applied to powder metallurgy, additive powders (an alloying powder, a cutting ability improving powder, and the like) may be further added and mixed for controlling the composition and the like of a sintered body before filling in a die and compaction molding.

EXAMPLE

Example 1

Each of the binders shown in Table 1, and an iron powder, a graphite powder, a Cu powder, and the like shown in Table 1 were heat-mixed with a Henschel-type high-speed mixer. Then, the resultant mixture was cooled to 60° C., and flowability-improving particles and a free lubricant shown in Tables 1 and 2 were added and mixed. The physical properties of the flowability-improving particles were as shown in Table 3. In some of the samples (Nos. 12 and 13), an iron powder previously subjected to wettability-improving treatment with a silane coupling agent (phenyltrimethoxy silane) under the above-described preferred conditions was used.

Figure 2A:
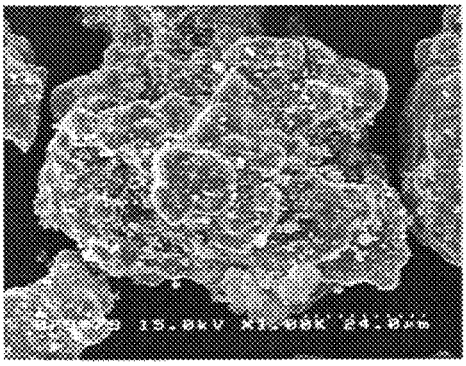
FIGS. 2A, 2B, and 2C are electron microscope photographs ("Good", "Poor", and "None", respectively) showing examples of evaluation of a degree of adhesion of flowability-improving particles to surfaces of iron-based powder.
Figure 2B:
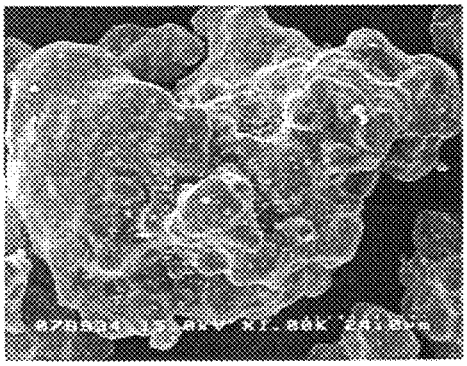
Figure 2C:
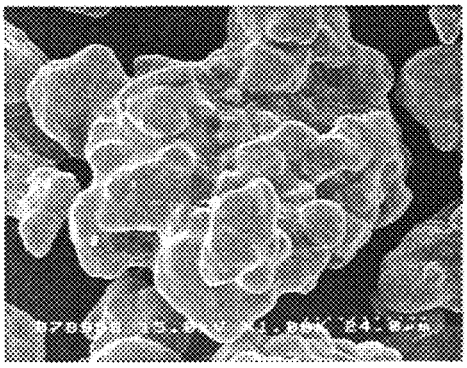

The surfaces of each of the resultant iron-based powders were observed with a scanning electron microscope (SEM) to evaluate the adhesion state of the flowability-improving particles. FIGS. 2A to 2C show examples of photographs taken for the surfaces of the iron-based powders together with the results of evaluation. In FIG. 2A, ○ (Good) indicates a satisfactory state in the present invention, and in FIG. 2B and FIG. 2C, Δ (Poor) and × (None) indicate unsatisfactory states, respectively.

Figure 3:
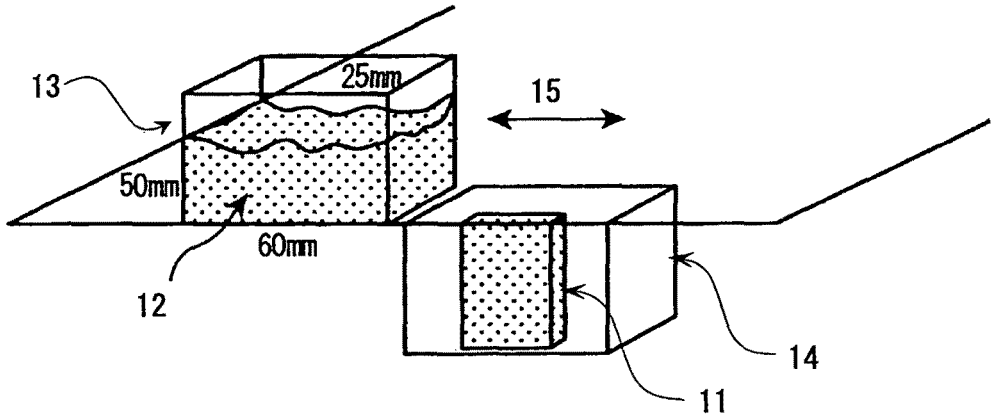
FIG. 3 is a perspective view schematically showing a principal portion of a filling tester.

The filling performance of each of the resultant iron-based powders was evaluated with a filling test machine shown in FIG. 3. In evaluation, a cavity 11 provided in a vessel 14 and having a length of 20 mm, a depth of 40 mm, and a width of 0.5 mm was filled with the iron-based powder from a filling shoe 13. The filling shoe 13 filled with the iron-based powder was moved in an arrowed moving direction 15 shown in FIG. 3 at a moving rate of 200 mm/sec and maintained above the cavity 11 for a retention time of 0.5 seconds. The percentage of filling density (filling weight/cavity volume) after filling to the apparent density before filling is determined as the filling rate (filling rate of 100% represents complete filling). The same test was repeated 10 times, and filling variation was represented by a standard deviation of filling rates. The results are shown in Table 2.

In addition, a mold was filled with each of the iron-based powders and compressed (compaction pressure 686 MPa) to form into a shape of tensile specimen having a thickness of 5 mm. Further, sintering (sintering temperature 1130° C., sintering time 20 minutes) was performed in a RX gas atmosphere to form a tensile specimen. The results of a tensile test are also shown in Table 2.

Any one of the invention examples shows a good adhesion state of the flowability-improving particles and good filling variation. Also, strength of sintered bodies is good.

When $TiO_2$ was used as the flowability-improving particles under the same conditions as the above, the filling variation can be minimized. It is found that by performing wettability-improving treatment, strength of a sintered compact is improved, and flowability is slightly improved as a whole.

In No. 17 in which the flowability-improving particles were not added and in No. 18 in which the flowability-improving particles were not sufficiently adhered to the iron powder surfaces, the filling variation is large.

Further, in No. 20 using as the flowability-improving particles $SiO_2$ having a melting point of 1450° C., flowability is good, but strength of a sintered compact is significantly decreased.

TABLE 1

| | Iron-based powder (parts by mass)*1 | | | | Wettability-improving agent (parts by mass*1) | Binder (parts by mass*1) | | | Free lubricant (parts by mass*1) | | | |
|---|---|---|---|---|---|---|---|---|---|---|---|---|
| No. | 301A*2 | 255M*3 | Graphite | Other (powder) | Silane coupling agent | Stearic acid amide | Ethylenebis (stearamide) | Zinc stearate | Ethylenebis (stearamide) | Stearic acid amide | Zinc stearate | Remarks |
| 1 | 97.4 | — | 0.6 | Cu: 2 | — | 0.3 | 0.3 | — | — | — | 0.2 | Example |
| 2 | 97.4 | — | 0.6 | Cu: 2 | — | 0.3 | 0.3 | — | — | — | 0.2 | Example |
| 3 | 97.4 | — | 0.6 | Cu: 2 | — | 0.3 | 0.3 | — | — | — | 0.2 | Example |

TABLE 1-continued

| No. | Iron-based powder (parts by mass)*1 | | | | Wettability-improving agent (parts by mass*1) | Binder (parts by mass*1) | | | Free lubricant (parts by mass*1) | | | Remarks |
|---|---|---|---|---|---|---|---|---|---|---|---|---|
| | 301A*2 | 255M*3 | Graphite | Other (powder) | Silane coupling agent | Stearic acid amide | Ethylenebis (stearamide) | Zinc stearate | Ethylenebis (stearamide) | Stearic acid amide | Zinc stearate | |
| 4 | 97.4 | — | 0.6 | Cu: 2 | — | 0.3 | 0.3 | — | — | — | 0.2 | Example |
| 5 | 97.4 | — | 0.6 | Cu: 2 | — | 0.3 | 0.3 | — | — | — | 0.2 | Example |
| 6 | 97.4 | — | 0.6 | Cu: 2 | — | 0.3 | 0.3 | — | — | — | 0.2 | Example |
| 7 | 97.4 | — | 0.6 | Cu: 2 | — | 0.3 | 0.3 | — | — | — | 0.2 | Example |
| 8 | 97.4 | — | 0.6 | Cu: 2 | — | 0.3 | 0.3 | — | — | — | 0.2 | Example |
| 9 | 87.4 | 10.0 | 0.6 | Cu: 2 | — | — | — | 0.4 | — | — | 0.4 | Example |
| 10 | 77.4 | 20.0 | 0.6 | Cu: 2 | — | — | — | 0.4 | — | — | 0.4 | Example |
| 11 | — | 97.4 | 0.6 | Cu: 2 | — | — | — | 0.4 | — | — | 0.4 | Example |
| 12 | 97.4 | — | 0.6 | Cu: 2 | 0.05 | 0.3 | 0.3 | — | — | — | 0.2 | Example |
| 13 | 97.4 | — | 0.6 | Cu: 2 | 0.05 | 0.3 | 0.3 | — | — | — | 0.2 | Example |
| 14 | 97.4 | — | 0.6 | Cu: 2 | — | 0.2 | 0.2 | — | 0.1 | 0.1 | 0.2 | Example |
| 15 | 97.4 | — | 0.6 | Cu: 2 | — | 0.2 | 0.2 | — | 0.15 | 0.15 | 0.1 | Example |
| 16 | 97.4 | — | 0.6 | Cu: 2 | — | — | — | 0.4 | — | — | 0.4 | Example |
| 17 | 97.4 | — | 0.6 | Cu: 2 | — | 0.3 | 0.3 | — | — | — | 0.2 | Comp. Example |
| 18 | 97.4 | — | 0.6 | Cu: 2 | — | 0.3 | 0.3 | — | — | — | 0.2 | Comp. Example |
| 19 | 97.4 | — | 0.6 | Cu: 2 | — | 0.3 | 0.3 | — | — | — | 0.2 | Comp. Example |
| 20 | 97.4 | — | 0.6 | Ni: 2 | — | 0.3 | 0.35 | — | — | — | 0.15 | Example |
| 21 | Alloy steel powder*4: 98.2 | | 0.8 | Cu: 1 | — | — | — | — | — | — | — | Example |
| 22 | 97.4 | — | 0.6 | Cu: 2 | — | — | — | 0.4 | — | — | 0.4 | Example |
| 23 | 97.4 | — | 0.6 | Cu: 2 | — | 0.3 | 0.3 | — | 0.1 | 0.1 | — | Example |
| 24 | 77.4 | SGM10CU-304*5: 20 | 0.6 | — | — | 0.3 | 0.3 | — | — | — | 0.2 | Example |

—: Not added

*1Value relative to 100 parts by mass of iron powder + alloy (graphite, Cu, Ni, Mo) powders (97.4% (in No. 2, 98.2%) of a value relative to 100 parts by mass of iron powder)

*2JIP(TM) 300A: atomized iron powder manufactured by JFE Steel Corporation, average particle diameter 70 to 90 μm

*3JIP(TM) 255A: reduced iron powder manufactured by JFE Steel Corporation, average particle diameter 70 to 90 μm

*4Atomized iron powder pre-alloyed with 0.45% by mass of Mo, average particle diameter 70 to 90 μm

*5SGM10CU-304: atomized iron powder to which 10% by mass of Cu was diffused and bonded

TABLE 2

| No. | Flowability-improving particles (parts by mass)*1 | | | | | | | | Evaluation*2 | Filling variation | Sintered compact tensile strength (MPa) | Remarks |
|---|---|---|---|---|---|---|---|---|---|---|---|---|
| | $TiO_2$ | $Al_2O_3$ | $ZrO_2$ | $Cr_2O_3$ | ZnO | PMMA | PE | $SiO_2$ | | | | |
| 1 | 0.05 | — | — | — | — | — | — | — | Good | 0.2 | 425 | Example |
| 2 | 0.1 | — | — | — | — | — | — | — | Good | 0.1 | 420 | Example |
| 3 | 0.2 | — | — | — | — | — | — | — | Good | 0.3 | 410 | Example |
| 4 | — | 0.1 | — | — | — | — | — | — | Good | 0.2 | 425 | Example |
| 5 | — | — | 0.2 | — | — | — | — | — | Good | 0.3 | 410 | Example |
| 6 | — | — | — | 0.1 | 0.1 | — | — | — | Good | 0.2 | 425 | Example |
| 7 | — | — | — | — | — | 0.1 | — | — | Good | 0.2 | 430 | Example |
| 8 | — | — | — | — | — | — | 0.1 | — | Good | 0.3 | 430 | Example |
| 9 | 0.1 | — | — | — | — | — | — | — | Good | 0.3 | 430 | Example |
| 10 | 0.1 | — | — | — | — | — | — | — | Good | 0.3 | 430 | Example |
| 11 | 0.1 | — | — | — | — | — | — | — | Good | 0.2 | 430 | Example |
| 12 | 0.1 | — | — | — | — | — | — | — | Good | 0.1 | 425 | Example |
| 13 | — | 0.05 | — | — | — | — | — | — | Good | 0.2 | 427 | Example |
| 14 | 0.1 | — | — | — | — | — | — | — | Good | 0.3 | 430 | Example |
| 15 | 0.1 | — | — | — | — | — | — | — | Good | 0.2 | 425 | Example |
| 16 | 0.1 | — | — | — | — | — | — | — | Good | 0.3 | 427 | Example |
| 17 | — | — | — | — | — | — | — | — | None | 2.0 | 430 | Comp. Example |
| 18 | 0.005 | — | — | — | — | — | — | — | Poor | 1.8 | 420 | Comp. Example |
| 19 | — | — | — | — | — | — | — | 0.2 | Good | 0.3 | 380 | Comp. Example |
| 20 | 0.05 | 0.05 | — | — | — | — | — | — | Good | 0.2 | 700 | Example |
| 21 | — | — | — | — | — | 0.1 | 0.1 | — | Good | 0.3 | 600 | Example |
| 22 | 0.05 | — | — | — | — | 0.05 | — | — | Good | 0.3 | 425 | Example |

TABLE 2-continued

| No. | Flowability-improving particles (parts by mass)*1 | | | | | | | | Evaluation*2 | Filling variation | Sintered compact tensile strength (MPa) | Remarks |
|---|---|---|---|---|---|---|---|---|---|---|---|---|
| | $TiO_2$ | $Al_2O_3$ | $ZrO_2$ | $Cr_2O_3$ | ZnO | PMMA | PE | $SiO_2$ | | | | |
| 23 | 0.02 | 0.02 | — | — | — | — | 0.02 | — | Good | 0.3 | 420 | Example |
| 24 | 0.1 | — | — | — | — | — | — | — | Good | 0.2 | 425 | Example |

—: Not added

*1Value relative to 100 parts by mass of iron powder + alloy (graphite, Cu, Ni, Mo) powders (97.4% (in No. 2, 98.2%) of a value relative to 100 parts by mass of iron powder)

*2Visual evaluation of an adhesion state of flowability-improving particles in a SEM image

TABLE 3

| Flowability-improving particles | Manufacturer | Trade name | Density ($Mg/m^3$) | AD (apparent density ($Mg/m^3$) | BET specific surface ($m^2/g$) | Average particle diameter (μm) | Single particle diameter (nm) | Melting point (° C.) |
|---|---|---|---|---|---|---|---|---|
| $TiO_2$ | Ishihara Sangyo Kaisha, Ltd. | A-100 | 3.7-3.9 | 0.2 | 237.2 | 0.2 | 6 | 1800 |
| $Al_2O_3$ | Nippon Aerosil Co., Ltd. | Alu C | 4.0 | 0.05 | 100 | | 13 | 2300 |
| $ZrO_2$ | Hakusui Tech Co., Ltd. | F-3 | 6.0 | 0.1 | 20 | 0.1 | 50 | 3000 |
| $Cr_2O_3$ | | | 5.2 | | | | | 2400 |
| ZnO | Hakusui Tech Co., Ltd. | F-3 | 5.7 | 0.1 | 20 | 0.1 | 50 | 2000 |
| PMMA | Zeon Kasei Co., Ltd. | F325 | 1 | 0.4 | 18.5 | 25 | 50 | — |
| PE | | | 1 | | | 5 | 100 | — |
| $SiO_2$ | Cabot Specialty Chemicals Inc. | CAB-O-SIL EH-5 | 2.2 | 0.016 | 299.1 | 0.2-0.3 | 9 | 1450 |

Blank: Unconfirmed

Example 2

Each of the binders shown in Table 4, and an iron powder, a graphite powder, a Cu powder, and the like shown in Table 4 were heat-mixed with a Henschel-type high-speed mixer. Then, the resultant mixture was cooled to 60° C., and a free lubricant and flowability-improving particles shown in Table 5 were added and mixed. In Nos. 31 to 33 and 36 to 40, the flowability-improving particles were previously mixed with an iron powder not having a binder and then mixed with an iron powder having a binder adhering thereto (the iron powder heat-mixed and then cooled to 60° C. as described above), while in Nos. 34 and 35, the flowability-improving particles and the iron powder not having the binder were separately mixed with an iron powder having a binder adhering thereto without previous mixing. In No. 40, an iron powder to which the binder was added was subjected to wettability-improving treatment as in Example 1.

Then, the same examination was in Example 1 was performed. The results are shown in Table 5. The adhesion state of the flowability-improving particles by a scanning electron microscope (SEM) was determined as (Good) in all samples.

Any one of the invention examples showed good filling performance. In comparison under the same conditions, when the flowability-improving particles were previously mixed with an iron powder not having the binder (Nos. 31 and 32), the filling performance was obviously improved as compared with the case in which the flowability-improving particles and the iron powder not having the binder were separately added (Nos. 34 and 35).

TABLE 4

| No. | Iron-based powder (with binder) (parts by mass)*1 | | | | Wettability-improving agent (parts by mass*1) | Iron powder (without Binder) (parts by mass*1) | | Flowability-improving particles*5 | Binder (parts by mass*1) | | | Remarks |
|---|---|---|---|---|---|---|---|---|---|---|---|---|
| | 301A*2 | 255M*3 | Graphite | Other (powder) | Silane coupling agent | 301A*2 | 255M*3 | | Stearic acid amide | Ethylenebis (stearamide) | Zinc stearate | |
| 31 | 97.4 | — | 0.6 | Cu: 2 | — | — | 5.0 | Mixing | 0.2 | 0.2 | — | Example |
| 32 | 77.4 | — | 0.6 | Cu: 2 | — | — | 20.0 | Mixing | 0.2 | 0.2 | — | Example |
| 33 | 57.4 | — | 0.6 | Cu: 2 | — | 40.0 | — | Mixing | — | — | 0.4 | Example |
| 34 | 92.4 | — | 0.6 | Cu: 2 | — | — | 5.0 | Separately | 0.2 | 0.2 | — | Example |
| 35 | 77.4 | — | 0.6 | Cu: 2 | — | — | 20.0 | Separately | 0.2 | 0.2 | — | Example |

TABLE 4-continued

| No. | Iron-based powder (with binder) (parts by mass)*1 | | | | Wettability-improving agent (parts by mass*1) | Iron powder (without Binder) (parts by mass*1) | | Flowability-improving particles*5 | Binder (parts by mass*1) | | | Remarks |
|---|---|---|---|---|---|---|---|---|---|---|---|---|
| | 301A*2 | 255M*3 | Graphite | Other (powder) | Silane coupling agent | 301A*2 | 255M*3 | | Stearic acid amide | Ethylenebis (stearamide) | Zinc stearate | |
| 36 | 92.4 | — | 0.6 | Cu: 2 | — | — | 5.0 | Mixing | — | — | 0.4 | Example |
| 37 | 97.4 | — | 0.6 | Cu: 1<br>Ni: 1 | — | — | 5.0 | Mixing | 0.2 | 0.2 | — | Example |
| 38 | Alloy steel powder*4: 94.4 | | 0.6 | — | — | — | 5.0 | Mixing | 0.2 | 0.2 | — | Example |
| 39 | 92.4 | — | 0.6 | Cu: 2 | — | — | 5.0 | Mixing | 0.2 | 0.2 | — | Example |
| 40 | 92.4 | — | 0.6 | Cu: 2 | 0.05 | — | 5.0 | Mixing | 0.2 | 0.2 | — | Example |

—: Not added

*1Value relative to 100 parts by mass of iron powder + alloy (graphite, Cu, Ni) powders (97.4% (in No. 38, 99.4%) of a value relative to 100 parts by mass of iron powder)

*2JIP(TM) 300A: atomized iron powder manufactured by JFE Steel Corporation, average particle diameter 70 to 90 μm

*3JIP(TM) 255A: reduced iron powder manufactured by JFE Steel Corporation, average particle diameter 70 to 90 μm

*4Atomized iron powder pre-alloyed with 2 parts by mass of Cu, average particle diameter 70 to 90 μm

*5Mixing: The flowability-improving particles were previously mixed with iron powder not having a binder. Separately: The flowability-improving particles were separately added without being previously mixed.

TABLE 5

| No. | Free lubricant (parts by mass)*1 | | | Flowability-improving particles (parts by mass)*1 | | | | Filling variation | Sintered compact tensile strength (MPa) | Remarks |
|---|---|---|---|---|---|---|---|---|---|---|
| | Ethylene-bis (stearamide) | Stearic acid amide | Zinc stearate | $TiO_2$ | PMMA | PE | Other | | | |
| 31 | 0.1 | 0.1 | 0.2 | 0.1 | — | — | — | 0.1 | 420 | Example |
| 32 | 0.15 | 0.15 | 0.1 | — | — | — | $Al_2O_3$: 0.05 | 0.2 | 427 | Example |
| 33 | — | — | 0.4 | 0.1 | — | — | — | 0.3 | 430 | Example |
| 34 | 0.15 | 0.15 | 0.1 | 0.1 | — | — | — | 0.2 | 420 | Example |
| 35 | 0.15 | 0.15 | 0.1 | — | — | — | $Al_2O_3$: 0.05 | 0.3 | 420 | Example |
| 36 | — | — | 0.4 | 0.15 | — | — | — | 0.1 | 410 | Example |
| 37 | 0.1 | 0.1 | 0.2 | 0.05 | 0.02 | 0.02 | — | 0.2 | 650 | Example |
| 38 | 0.1 | 0.1 | 0.2 | — | 0.1 | — | — | 0.3 | 420 | Example |
| 39 | 0.1 | 0.1 | 0.2 | 0.05 | — | — | $ZrO_2$, $Cr_2O_3$, ZnO: each 0.05 | 0.3 | 420 | Example |
| 40 | 0.1 | 0.1 | 0.2 | 0.1 | — | — | — | 0.2 | 420 | Example |

—: Not added

*1Value relative to 100 parts by mass of iron powder + alloy (graphite, Cu, Ni) powders (97.4% (in No. 38, 99.4%) of a value relative to 100 parts by mass of iron powder)

Industrial Applicability

According to the present invention, it is possible to produce an iron-based powder containing an iron powder as a material, having excellent flowability, and being suitable for use in powder metallurgy without decreasing the mechanical properties of sintered compacts.

The invention claimed:

1. An iron-based powder for powder metallurgy comprising iron powder with surfaces to each of which flowability-improving particles adhere through a binder, wherein the flowability-improving particles include PMMA and/or PE, and the average particle diameter of the flowability-improving particles is in a range of 5 to 500 nm.

2. The iron-based powder for powder metallurgy according to claim 1, wherein the iron powder contains less than 50% by mass of an iron powder not having the binder.

3. The iron-based powder for powder metallurgy according to claim 1, wherein the surfaces of the iron powder are previously treated with a wettability-improving agent to improve wettability with the binder.

4. The iron-based powder for powder metallurgy according to claim 1, wherein the binder is at least one selected from zinc stearate, lithium stearate, calcium stearate, stearic acid monoamide, and ethylenebis(stearamide).

5. The iron-based powder for powder metallurgy according to claim 1, wherein the iron powder is an atomized iron powder and/or a reduced iron powder.

6. The iron-based powder for powder metallurgy according to claim 1, wherein the flowability-improving particles are contained at a ratio of 0.01 to 0.3 parts by mass relative to 100 parts by mass of the iron powder.

7. A method for producing an iron-based powder comprising:

a step of dividing a starting iron-based powder into at least two portions, the two portions including a first iron-based powder and a second iron-based powder;

a step of adhering a binder to the first-based powder;

a step of mixing flowability-improving particles with the second iron-based powder; and a step of subsequently mixing the first iron-based powder with the second iron-based powder, wherein the amount of the second iron-based powder is less than 50% by mass of the starting iron-based powder.

8. The method for producing an iron-based powder according to claim 7, wherein the amount of the second iron-based powder is between 5% and 20% by mass of the starting iron-based powder.

* * * * *